US006960370B2

(12) United States Patent
Monni et al.

(10) Patent No.: US 6,960,370 B2
(45) Date of Patent: Nov. 1, 2005

(54) METHODS OF FORMING MEDICAL DEVICES

(75) Inventors: Vittorino Monni, Seattle, WA (US); Verivada Chandrasekaran, Mercer Island, WA (US); Outhay Voraphet, Redmond, WA (US)

(73) Assignee: SciMed Life Systems, Inc., Maple Grove, MN (US)

( * ) Notice: Subject to any disclaimer, the term of this patent is extended or adjusted under 35 U.S.C. 154(b) by 178 days.

(21) Appl. No.: 10/400,762

(22) Filed: Mar. 27, 2003

(65) Prior Publication Data

US 2004/0188261 A1 Sep. 30, 2004

(51) Int. Cl.[7] ..... B05D 3/00; B05D 3/04; C25D 5/34; C25D 5/38

(52) U.S. Cl. ..... 427/301; 427/304; 427/305; 427/308; 427/327; 205/210; 205/212; 205/216; 205/217; 205/103; 205/114

(58) Field of Search ..... 427/327, 301, 427/304, 305, 308; 205/210, 212, 216, 217, 103, 114

(56) References Cited

U.S. PATENT DOCUMENTS

| | | | | |
|---|---|---|---|---|
| 3,472,230 A | | 10/1969 | Fogarty | |
| 3,562,013 A | | 2/1971 | Mickelson et al. | |
| 3,841,905 A | | 10/1974 | Dixon, III | |
| 3,868,620 A | * | 2/1975 | McBride et al. | 338/28 |
| 3,926,699 A | | 12/1975 | Dixon | |
| 3,952,747 A | | 4/1976 | Kimmell, Jr. | |
| 3,990,982 A | | 11/1976 | Dixon | |
| 3,996,938 A | | 12/1976 | Clark, III | |
| RE29,181 E | | 4/1977 | Dixon, III | |
| 4,029,556 A | | 6/1977 | Monaco et al. | |
| 4,046,150 A | | 9/1977 | Schwartz et al. | |
| 4,297,257 A | | 10/1981 | Elias et al. | |
| 4,314,876 A | | 2/1982 | Kremer et al. | |
| 4,410,396 A | | 10/1983 | Somers et al. | |
| 4,416,739 A | | 11/1983 | Turner | |
| 4,425,908 A | | 1/1984 | Simon | |
| 4,525,250 A | | 6/1985 | Fahrmbacher-Lutz et al. | |
| 4,590,938 A | | 5/1986 | Segura et al. | |
| 4,591,088 A | | 5/1986 | Mulliner et al. | |
| 4,619,246 A | | 10/1986 | Molgaard-Nielsen et al. | |
| 4,650,466 A | | 3/1987 | Luther | |
| 4,673,521 A | | 6/1987 | Sullivan et al. | |
| 4,706,671 A | | 11/1987 | Weinrib | |
| 4,723,549 A | | 2/1988 | Wholey et al. | |
| 4,790,812 A | | 12/1988 | Hawkins, Jr. et al. | |
| 4,790,813 A | | 12/1988 | Kensey | |
| 4,790,902 A | | 12/1988 | Wada et al. | 156/630 |
| 4,794,928 A | | 1/1989 | Kletschka | |

(Continued)

FOREIGN PATENT DOCUMENTS

| | | |
|---|---|---|
| DE | 28 21 048 | 7/1980 |
| DE | 34 17 738 | 11/1985 |

(Continued)

OTHER PUBLICATIONS

Makovskii et al., "Pickling of Oxidized High–Nickel Chromium Alloys and Stainless Steels", Zhurnal Prikladnoi Khimii (Sankt–Peterburg, Russian Federation) (no month, 1983), vol. 56, No. 6, pp. 1389–1392). Abstract only.*

(Continued)

*Primary Examiner*—Edna Wong
(74) *Attorney, Agent, or Firm*—Crompton, Seager & Tufte LLC

(57) ABSTRACT

Medical devices that include oxidizable portions can be plated after a two step activation process that includes successive applications of two aqueous solutions of ammonium bifluoride. Once plated, such materials can be soldered using conventional solders and fluxes. Medical devices can be assembled by soldering together plated materials. Oxidizable materials can be plated with radiopaque materials to yield medical devices that are more visible to fluoroscopy.

41 Claims, 4 Drawing Sheets

U.S. PATENT DOCUMENTS 4,807,626 A 2/1989 McGirr
4,873,978 A 10/1989 Ginsburg
4,921,478 A 5/1990 Solano et al.
4,921,484 A 5/1990 Hillstead
4,926,858 A 5/1990 Gifford, III et al.
4,938,850 A 7/1990 Rothschild et al.
4,944,851 A 7/1990 Cordani et al.
4,963,233 A 10/1990 Mathew
4,969,891 A 11/1990 Gewertz
4,998,539 A 3/1991 Delsanti
5,002,560 A 3/1991 Machold et al.
5,011,488 A 4/1991 Ginsburg
5,022,935 A 6/1991 Fisher
5,053,008 A 10/1991 Bajaj
5,071,407 A 12/1991 Termin et al.
5,100,423 A 3/1992 Fearnot
5,100,500 A * 3/1992 Dastolfo et al. ..... 216/108
5,102,415 A 4/1992 Guenther et al.
5,109,593 A 5/1992 Benz et al.
5,133,733 A 7/1992 Rasmussen et al.
5,134,040 A 7/1992 Benz et al.
5,152,771 A 10/1992 Sabbaghian et al.
5,152,777 A 10/1992 Goldberg et al.
5,160,342 A 11/1992 Reger et al.
5,211,775 A 5/1993 Fisher et al.
5,224,953 A 7/1993 Morgentaler
5,242,759 A 9/1993 Hall
5,329,942 A 7/1994 Gunther et al.
5,330,484 A 7/1994 Gunther
5,354,310 A 10/1994 Garnie et al.
5,354,623 A 10/1994 Hall
5,376,100 A 12/1994 Lefebvre
5,421,832 A 6/1995 Lefebvre
5,423,742 A 6/1995 Theron
5,449,372 A 9/1995 Schmaltz et al.
4,842,579 A 10/1995 Shiber
5,456,667 A 10/1995 Ham et al.
5,462,529 A 10/1995 Simpson et al.
5,464,524 A 11/1995 Ogiwara et al.
5,536,242 A 7/1996 Willard et al.
5,549,626 A 8/1996 Miller et al.
5,658,296 A 8/1997 Bates et al.
5,662,671 A 9/1997 Barbut et al.
5,695,519 A 12/1997 Summers et al.
5,720,764 A 2/1998 Naderlinger
5,728,066 A 3/1998 Daneshvar
5,749,848 A 5/1998 Jang et al.
5,769,816 A 6/1998 Barbut et al.
5,779,716 A 7/1998 Cano et al.
5,792,157 A 8/1998 Mische et al.
5,795,322 A 8/1998 Boudewijn
5,800,457 A 9/1998 Gelbfish
5,800,509 A 9/1998 Boneau
5,800,525 A 9/1998 Bachinski et al.
5,810,874 A 9/1998 Lefebvre
5,814,064 A 9/1998 Daniel et al.
5,827,324 A 10/1998 Cassell et al.
5,833,644 A 11/1998 Zadno-Azizi et al.
5,833,650 A 11/1998 Imran
5,846,260 A 12/1998 Maahs
5,848,964 A 12/1998 Samuels
5,876,367 A 3/1999 Kaganov et al.
5,882,193 A 3/1999 Wool
5,895,399 A 4/1999 Barbut et al.
5,897,567 A 4/1999 Ressemann et al.
5,910,154 A 6/1999 Tsugita et al.
5,911,734 A 6/1999 Tsugita et al.
5,919,126 A 7/1999 Armini ..... 600/1
5,925,016 A 7/1999 Chornenky et al.
5,925,060 A 7/1999 Forber
5,925,062 A 7/1999 Purdy
5,935,139 A 8/1999 Bates
5,941,869 A 8/1999 Patterson et al.
5,941,896 A 8/1999 Kerr
5,947,995 A 9/1999 Samuels
5,954,745 A 9/1999 Gertler et al.
5,980,555 A 11/1999 Barbut et al.
5,989,281 A 11/1999 Barbut et al.
5,993,469 A 11/1999 McKenzie et al.
5,997,557 A 12/1999 Barbut et al.
6,001,118 A 12/1999 Daniel et al.
6,007,557 A 12/1999 Ambrisco et al.
6,010,522 A 1/2000 Barbut et al.
6,013,085 A 1/2000 Howard
6,027,520 A 2/2000 Tsugita et al.
6,042,598 A 3/2000 Tsugita et al.
6,051,014 A 4/2000 Jang
6,051,015 A 4/2000 Maahs
6,053,932 A 4/2000 Daniel et al.
6,059,814 A 5/2000 Ladd
6,066,149 A 5/2000 Samson et al.
6,066,158 A 5/2000 Engelson et al.
6,068,645 A 5/2000 Tu
6,086,605 A 7/2000 Barbut et al.
6,117,154 A 9/2000 Barbut et al.
6,129,739 A 10/2000 Khosravi
6,136,016 A 10/2000 Barbut et al.
6,142,987 A 11/2000 Tsugita
6,152,946 A 11/2000 Broome et al.
6,165,200 A 12/2000 Tsugita et al.
6,168,579 B1 1/2001 Tsugita
6,171,327 B1 1/2001 Daniel et al.
6,171,328 B1 1/2001 Addis
6,179,851 B1 1/2001 Barbut et al.
6,179,859 B1 1/2001 Bates et al.
6,179,861 B1 1/2001 Khosravi et al.
6,203,561 B1 3/2001 Ramee et al.
6,206,868 B1 3/2001 Parodi
6,214,026 B1 4/2001 Lepak et al.
6,221,006 B1 4/2001 Dubrul et al.
6,224,620 B1 5/2001 Maahs
6,231,544 B1 5/2001 Tsugita et al.
6,235,044 B1 5/2001 Root et al.
6,235,045 B1 5/2001 Barbut et al.
6,238,412 B1 5/2001 Dubrul et al.
6,245,087 B1 6/2001 Addis
6,245,088 B1 6/2001 Lowery
6,245,089 B1 6/2001 Daniel et al.
6,258,115 B1 7/2001 Dubrul
6,264,663 B1 7/2001 Cano
6,264,672 B1 7/2001 Fisher
6,267,650 B1 7/2001 Hembree
6,270,513 B1 8/2001 Tsugita et al.
6,277,138 B1 8/2001 Levinson et al.
6,277,139 B1 8/2001 Levinson et al.
6,280,413 B1 8/2001 Clark et al.
6,287,321 B1 9/2001 Jang
6,290,710 B1 9/2001 Cryer et al.
6,309,399 B1 10/2001 Barbut et al.
6,319,268 B1 11/2001 Ambrisco et al.
6,339,047 B1 1/2002 Christopherson et al.
6,344,049 B1 2/2002 Levinson et al.
6,416,386 B2 7/2002 Hembree
6,416,387 B2 7/2002 Hembree
6,416,388 B2 7/2002 Hembree
6,416,395 B1 7/2002 Hembree
6,416,397 B2 7/2002 Hembree
6,416,398 B2 7/2002 Hembree
6,416,399 B2 7/2002 Hembree
6,419,550 B2 7/2002 Hembree
6,422,919 B2 7/2002 Hembree

| | | | |
|---|---|---|---|
| 6,422,923 | B2 | 7/2002 | Hembree |
| 6,431,952 | B2 | 8/2002 | Hembree |
| 6,447,664 | B1 | 9/2002 | Taskovics et al. |
| 2001/0044262 | A1 | 11/2001 | Hembree |
| 2001/0046832 | A1 | 11/2001 | Hembree |

FOREIGN PATENT DOCUMENTS

| | | | | | |
|---|---|---|---|---|---|
| DE | 40 30 998 | A1 | | 10/1990 | |
| DE | 199 16 162 | | | 10/2000 | |
| EP | 0 200 688 | | | 11/1986 | |
| EP | 0 293 605 | A1 | | 12/1988 | |
| EP | 0 411 118 | A1 | | 2/1991 | |
| EP | 0 427 429 | A2 | | 5/1991 | |
| EP | 0 437 121 | B1 | | 7/1991 | |
| EP | 449646 | A2 | * | 10/1991 | ..... B24B/31/14 |
| EP | 0 472 334 | A1 | | 2/1992 | |
| EP | 0 472 368 | A2 | | 2/1992 | |
| EP | 0 533 511 | A1 | | 3/1993 | |
| EP | 0 655 228 | A1 | | 11/1994 | |
| EP | 0 686 379 | A2 | | 6/1995 | |
| EP | 0 696 447 | A2 | | 2/1996 | |
| EP | 0 737 450 | A1 | | 10/1996 | |
| EP | 0 743 046 | A1 | | 11/1996 | |
| EP | 0 759 287 | A1 | | 2/1997 | |
| EP | 0 771 549 | A2 | | 5/1997 | |
| EP | 0 784 988 | A1 | | 7/1997 | |
| EP | 0 852 132 | A1 | | 7/1998 | |
| EP | 0 934 729 | | | 8/1999 | |
| EP | 1 127 556 | A2 | | 8/2001 | |
| FR | 2 580 504 | | | 10/1986 | |
| FR | 2 643 250 | A1 | | 8/1990 | |
| FR | 2 666 980 | | | 3/1992 | |
| FR | 2 694 687 | | | 8/1992 | |
| FR | 2 768 326 | A1 | | 3/1999 | |
| GB | 2 020 557 | B | | 1/1983 | |
| JP | 6 116 782 | | | 4/1994 | |
| JP | 8-187294 | A | | 7/1996 | |
| JP | 08218185 | A | * | 8/1996 | ..... C23F/1/26 |
| SU | 764684 | | | 9/1980 | |
| WO | WO 88/09683 | | | 12/1988 | |
| WO | WO 92/03097 | | | 3/1992 | |
| WO | WO 94/14389 | | | 7/1994 | |
| WO | WO 94/24946 | | | 11/1994 | |
| WO | WO 96/01591 | | | 1/1996 | |
| WO | WO 96/10375 | | | 4/1996 | |
| WO | WO 96/19941 | | | 7/1996 | |
| WO | WO 96/23441 | | | 8/1996 | |
| WO | WO 96/33677 | | | 10/1996 | |
| WO | WO 97/17100 | | | 5/1997 | |
| WO | WO 97/27808 | | | 8/1997 | |
| WO | WO 97/42879 | | | 11/1997 | |
| WO | WO 98/02084 | | | 1/1998 | |
| WO | WO 98/02112 | | | 1/1998 | |
| WO | WO 98/23322 | | | 6/1998 | |
| WO | WO 98/33443 | | | 8/1998 | |
| WO | WO 98/34673 | | | 8/1998 | |
| WO | WO 98/36786 | | | 8/1998 | |
| WO | WO 98/38920 | | | 9/1998 | |
| WO | WO 98/38929 | | | 9/1998 | |
| WO | WO 98/39046 | | | 9/1998 | |
| WO | WO 98/39053 | | | 9/1998 | |
| WO | WO 98/46297 | | | 10/1998 | |
| WO | WO 98/47447 | | | 10/1998 | |
| WO | WO 98/49952 | | | 11/1998 | |
| WO | WO 98/50103 | | | 11/1998 | |
| WO | WO 98/51237 | | | 11/1998 | |
| WO | WO 98/55175 | | | 12/1998 | |
| WO | WO 99/09895 | | | 3/1999 | |
| WO | WO 99/22673 | | | 5/1999 | |
| WO | WO 99/23976 | | | 5/1999 | |
| WO | WO 99/25252 | | | 5/1999 | |
| WO | WO 99/30766 | | | 6/1999 | |
| WO | WO 99/40964 | | | 8/1999 | |
| WO | WO 99/42059 | | | 8/1999 | |
| WO | WO 99/44510 | | | 9/1999 | |
| WO | WO 99/44542 | | | 9/1999 | |
| WO | WO 99/55236 | | | 11/1999 | |
| WO | WO 99/58068 | | | 11/1999 | |
| WO | WO 00/07521 | | | 2/2000 | |
| WO | WO 00/07655 | | | 2/2000 | |
| WO | WO 00/09054 | | | 2/2000 | |
| WO | WO 00/16705 | | | 3/2000 | |
| WO | WO 00/49970 | | | 8/2000 | |
| WO | WO 00/53120 | | | 9/2000 | |
| WO | WO 00/67664 | | | 11/2000 | |
| WO | WO 00/67665 | | | 11/2000 | |
| WO | WO 00/67666 | | | 11/2000 | |
| WO | WO 00/67668 | | | 11/2000 | |
| WO | WO 00/67669 | | | 11/2000 | |
| WO | WO 01/05462 | | | 1/2001 | |
| WO | WO 01/08595 | | | 2/2001 | |
| WO | WO 01/08596 | | | 2/2001 | |
| WO | WO 01/08742 | | | 2/2001 | |
| WO | WO 01/08743 | | | 2/2001 | |
| WO | WO 01/10320 | | | 2/2001 | |
| WO | WO 01/15629 | | | 3/2001 | |
| WO | WO 01/21077 | | | 3/2001 | |
| WO | WO 01/21100 | | | 3/2001 | |
| WO | WO 01/26726 | | | 4/2001 | |
| WO | WO 01/35857 | | | 5/2001 | |
| WO | WO 01/43662 | | | 6/2001 | |
| WO | WO 01/47579 | | | 7/2001 | |
| WO | WO 01/49208 | | | 7/2001 | |
| WO | WO 01/49209 | | | 7/2001 | |
| WO | WO 01/49215 | | | 7/2001 | |
| WO | WO 01/49355 | | | 7/2001 | |
| WO | WO 01/52768 | | | 7/2001 | |
| WO | WO 01/58382 | | | 8/2001 | |
| WO | WO 01/60442 | | | 8/2001 | |
| WO | WO 01/67989 | | | 9/2001 | |
| WO | WO 01/70326 | | | 9/2001 | |
| WO | WO 01/72205 | | | 10/2001 | |
| WO | WO 01/87183 | | | 11/2001 | |
| WO | WO 01/89413 | | | 11/2001 | |
| WO | WO 01/91824 | | | 12/2002 | |

OTHER PUBLICATIONS

Van Horn, "Pluse Plating", dynatronix.com, pp. 1–13, Aug. 5, 1999.*

"Atherosclerotic Disease of the Aortic Arch as a Risk Factor of Recurrent Ischemic Stroke," *The New England Journal of Medicine*, pp. 1216–1221 (May 1996).

"Endovascular Grafts, Stents Drive Interventional Radiology Growth," *Cardiovascular* Device Update, 2(3):1–12 (Mar. 1996).

"Protruding Atheromas in the Thoracic Aortic and Systemic Embolization," pp. 423–427 American College of Physicians (1991), no month.

"Recognition and Embolic Potential of Intraaortic Atherosclerotic Debris," American College of Cardiology (Jan. 1991).

Cragg, Andrew et al., "A New Percutaneous Vena Cava Filger," *AJR, 141*:601–604 (Sep. 1983).

Cragg, Andrew et al., "Nonsurgical Placement of Arterial Endoprosthesis: A New Technique Using Nitinol Wire," *AJR*, pp. 261–263 (Apr. 1983).

Diethrich et al., "Percutaneous Techniques for Endoluminal Carotid Interventions," *J. Endovasc. Surg.*, 3:182–202 (1996), no month.

Fadali, A. Moneim, "A filtering device for the prevention of particulate embolization during the course of cardiac surgery," *Surgery, 64*(3):634–639 (Sep. 1968).
Haissaguerre et al., "Spontaneous Initiation of Atrial Fibrillation by Ectopic Beats Originating in the Pulmonay Veins," *The New England Journal of Medicine, 339*(10):659–666 (Sep. 1988).
Jordan, Jr. et al., "Microemboli Detected by Transcranial Doppler Monitoring . . . ," *Cardiovascular Surgery*, 7(1)33–38 (Jan. 1999).
Lesh, "Can Catheter Ablation Cure Atrial Fibrillation?" *ACC Current Journal Review*, pp. 38–40 (Sep./Oct. 1997).
Lund et al., "Long–Term Patency of Ductus Arteriosus After Balloon Dilation: an Experimental Study," *Laboratory Investigation, 69*(4):772–774 (Apr. 1984).
Marache et al., "Percutaneous Transluminal Venous Angioplasty . . . ," *American Heart Journal*, 125(2 Pt 1):362–366 (Feb. 1993).
Mazur et al., "Directional Atherectomy with the Omincath™: A Unique New Catheter System," *Catheterization and Cardiovascular Diagnosis*, 31:17–84 (1994), no month.
Moussa, MD, Issaam "Stents Don't Require Systemic Anticoagulation . . . But the Technique (and Results) Must be Optimal," Journal of Invasive Cardiol., 8(E):3E–7E, (1996), no month.
Nakanishi et al., "Catheter Intervention to Venous System Using Expandable Metallic Stents," *Rinsho Kyobu Geka, 14*(2):English Abstract Only (Apr. 1994).
Onal et al., "Primary Stenting for Complex Atherosclerotic Plaques in Aortic and Iliac Stenoses," *Cardiovascular & Interventional Radiology, 21*(5):386–392 (1998), no month.
Theron et al., "New Triple Coaxial Catheter System for Carotid Angioplasty with Cerebral Protection," *American Journal of Neuroradiology, 11*:869–874 (1990), no month.
Tunick et al., "Protruding atherosclerotic plaque in the aortic archo f patients with systemic embolization: A new finding seen by transesophageal echocardiography," *American Heart Journal 120*(3):658–660 (Sep. 1990).
Waksman et al., "Distal Embolization is Common After Directional Atherectomy . . . ," *American Heart Journal, 129*(3):430–435 (1995), no month.
Wholey, Mark H. et al., PTA and Stents in the Treatment of Extracranial Circulation, *The Journal of Invasive Cardiology,8*(E):25E–30E (1996), no month.

* cited by examiner

METHODS OF FORMING MEDICAL DEVICES

TECHNICAL FIELD

The invention relates generally to medical devices and more specifically to methods of plating and soldering together portions of medical devices.

BACKGROUND

Medical devices such as distal protection filters and guidewires can include portions that are made from a variety of different metals. Some of these metals, such as stainless steel and nickel/titanium alloys, are readily oxidized when exposed to air. It has been found that a surface layer of oxidized metal can interfere with soldering processes.

Thus, a need remains for an improved method of soldering oxidizable metals such as stainless steel and nitinol.

SUMMARY

The present invention is directed to an improved method of plating oxidizable materials. Once plated, such materials can be soldered using conventional solders and fluxes. Medical devices can be assembled by soldering together plated materials. Oxidizable materials can be plated with radiopaque materials to yield medical devices that are more visible to fluoroscopy.

Accordingly, an embodiment of the present invention can be found in a method of plating a medical device that includes an oxidizable substrate. The substrate can be cleaned with a cleaning and etching solution, and can be activated with a concentrated aqueous solution of ammonium bifluoride. A rinsing step ensues in which the substrate can be rinsed with a dilute aqueous solution of ammonium bifluoride. The substrate can be plated with a plating material.

Another embodiment of the present invention is found in a method of forming a medical device that has a first metal part and a second metal part. The first metal part is made of an oxidizable metal. The first metal part can be cleaned with a cleaning and etching solution and can then be activated with a concentrated aqueous solution of ammonium bifluoride. The first metal part can be rinsed with a dilute aqueous solution of ammonium bifluoride and can be electroplated. Finally, the plated first metal part can be soldered to the second metal part. In a particular embodiment, the second metal part is also treated as described above, prior to soldering.

An embodiment of the present invention is found in a method of forming a filter wire loop from a nitinol filter wire that is secured at either end to a stainless steel wire. Both ends of the nitinol wire can be cleaned with a cleaning and etching solution and can then be activated with an aqueous solution that includes about 10 to 40 weight percent ammonium bifluoride. The ends of the wire can be rinsed with an aqueous solution that includes about 1 to 10 weight percent ammonium bifluoride. Both ends can be electroplated with a plating material that includes nickel. The plated ends can be positioned in alignment with the stainless steel wire and are soldered into position.

Another embodiment of the present invention is found in a method of increasing the radiopacity of a medical device that has an oxidizable substrate. The substrate can be cleaned with a cleaning and etching solution and can be activated with an aqueous solution that includes about 10 to 40 weight percent of ammonium bifluoride and can subsequently be rinsed with an aqueous solution that includes about 1 to 10 weight percent ammonium bifluoride. The activated and rinsed substrate can be electroplated with a radiopaque material.

DETAILED DESCRIPTION

Figure 1:
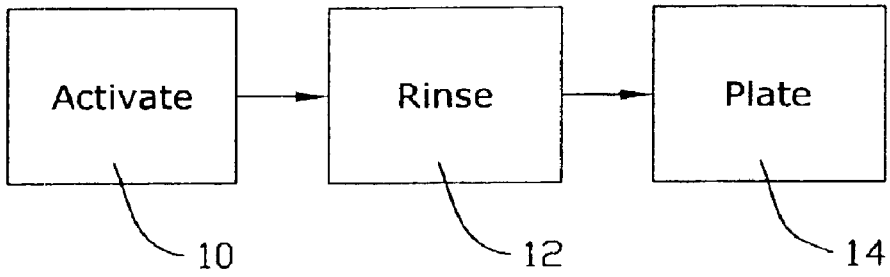
FIG. 1 is a diagrammatic illustration of a plating method in accordance with an embodiment of the invention.

The invention is directed to plating oxidizable materials that subsequently can be soldered using conventional solders and fluxes. Medical devices can be assembled by soldering together plated materials. Oxidizable materials can be plated with radiopaque materials to yield medical deviecs that are more visible to fluoroscopy.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value, i.e. having the same function or result. In many instances, the term "about" can include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

As used in this specification and the appended claims, any reference to "percent" or "%" are intended to be defined as weight percent, unless explicitly described to the contrary.

The following description should be read with reference to the illustrative but non-limiting drawings wherein like reference numerals indicate like elements throughout the several views.

FIG. 1 provides an overview of a medical device plating method in accordance with an embodiment of the invention. In broad terms, this method prepares an oxidizable substrate such as a nickel-titanium alloy, stainless steel or titanium for plating and then plates the prepared substrate.

In particular, FIG. 1 illustrates a three step process. In some embodiments, an activation step 10 can include submerging, dipping, spraying or otherwise contacting the oxidizable substrate with an activation solution. The activation solution can be a concentrated aqueous solution of ammonium bifluoride. In some embodiments, the activation solution can contain in the range of about 10 to about 40 weight percent ammonium bifluoride dissolved in water. In some embodiments, the activation solution can contain about 25 weight percent ammonium bifluoride dissolved in deionized (DI) water.

In the activation step 10, the substrate is contacted by the activation solution for a period of time sufficient to remove most if not all of the oxidation. The amount of time necessary can vary, depending on the ammonium bifluoride concentration of the activation solution. In some embodiments, the activation step 10 can include contacting the substrate with the activation solution for a period of time that is in the range of about 1 minute to about 30 minutes or for example, about 5 minutes.

Without wishing to be bound or limited by theory, it is believed that activation step 10 results in a substrate that is largely free of oxidation by reducing any oxidized metal back to its native form. If for example the substrate is a nickel-titanium alloy such as nitinol, the activation step 10 is believed to reduce most if not all of the $TiO_2$ back to elemental titanium.

The activation step 10 can be followed by a rinse step 12. In some embodiments, the rinse step 12 can include submerging, dipping, spraying or otherwise contacting the substrate with a rinse solution. The rinse solution can be a dilute aqueous solution of ammonium bifluoride. In some embodiments, the rinse solution can contain in the range of about 1 to 10 weight percent ammonium bifluoride dissolved in water. In some embodiments, the rinse solution can contain about 5 weight percent ammonium bifluoride dissolved in DI water.

In the rinse step 12, the substrate is contacted with the rinse solution for a period of time sufficient to remove excess ammonium bifluoride from the substrate. The amount of time can vary, depending on the ammonium bifluoride concentration on the surface of the substrate as well as that of the rinse solution. It is recognized that as activated substrates (from activation step 10) undergo the rinse step 12, the ammonium bifluoride concentration within the rinse solution will increase. In some embodiments, the rinse step 12 can include contacting the substrate with the rinse solution for a period of time that is in the range of about 1 minute or less, for example about 30 seconds.

Without wishing to be bound or limited by theory, it is believed that the rinse step 12 removes excess ammonium bifluoride from the surface of the substrate yet leaves sufficient ammonium bifluoride to provide temporary protection against oxidation. As a result, the activated and rinsed substrate can be moved to a plating step 14 without requiring an oxygen-free environment. Of course, an inert atmosphere such as a nitrogen atmosphere could be employed, but such is neither necessary nor warranted.

Once the substrate has undergone the activation step 10 and the rinse step 12, the substrate progresses to the plating step 14. The plating step 14 can include any conventional plating process, such as electroplating or reverse current electroplating, or any known deposition process such as vapor deposition, reactive spottering, ion implantation and others.

In some embodiments, the plating step 14 involves an electroplating process. Electroplating is well known in the art and thus a detailed description thereof is not necessary herein. In some embodiments, a reverse current electroplating process can be used. It is believed that using a reverse current electroplating process can retard or even reverse any slight oxidation that may occur between the rinse step 12 and the plating step 14.

The substrate can be plated with a variety of different materials, depending on the processing requirements of subsequent manufacturing steps and the end use of the medical device that includes or contains the substrate. In some embodiments, the substrate once plated will be soldered, and it can be advantageous to provide a plating material that will be compatible with or complementary to whichever solder and flux are used.

In some embodiments, the plating material includes nickel and tin. The plating material can include tin in the range of about 60 to 70 weight percent of the plating and can include nickel in the range of about 30 to 40 weight percent of the plating. In some embodiments, the plating can include about 65 weight percent tin and about 35 weight percent nickel. The electroplating bath can include tin and nickel in amounts sufficient to achieve these plating compositions.

In some embodiments, the substrate will not be soldered. Instead, the substrate can be plated with a material that will increase the radiopacity of the substrate. In these embodiments, the substrate can be plated with a radiopaque material such as gold. The electroplating batch can include gold or other appropriate radiopaque materials in amounts sufficient to achieve an adequate coating.

In some embodiments, the electroplating bath will include amounts of ammonium bifluoride to aid in retarding or reversing any minor oxidation that occurs between the rinse step 12 and the plating step 14. The bath can also include stannose fluoborate, ammonium bifluoride and nickel sulfate.

An electroplating process can be defined in part by the power levels and time used in electroplating a substrate. In some embodiments, the plating step 14 can include plating at a current that is in the range of about 150 mA and about 200 mA for a period of about 15 to about 30 minutes, for example 22 minutes and 175 mA. Time and current may vary depending on amount of parts loaded. If more parts are loaded, increase time or current accordingly should be increased.

Activation and plating methods in accordance with various embodiments of the invention can involved additional steps prior to the activation step 10. For example, in some embodiments, the substrate can be cleaned or can be cleaned and etched prior to activation. A cleaning and etching solution can include any suitable chemicals that are intended to prepare the substrate for activation. In some embodiments, the cleaning and etching solution can include sulfamic acid and hydrogen peroxide.

A cleaning or cleaning and etching step can include submerging or otherwise contacting the substrate with the cleaning or cleaning and etching solution for a sufficient period of time to prepare the substrate for activation. In some embodiments, the substrate can be submerged or otherwise contacted with the cleaning or cleaning and etching solution for a period of time in the range of about less than one minute to about ten minutes. In some embodiments, the cleaning or cleaning and etching process can include ultrasonic cleaning, for approximately 5 minutes, for example.

In some embodiments, a cleaning or cleaning and etching step can be followed by a water rinse. In some embodiments, the plating step 14 can be followed by a water rinse, with or without ultrasonic agitation.

Figure 2:
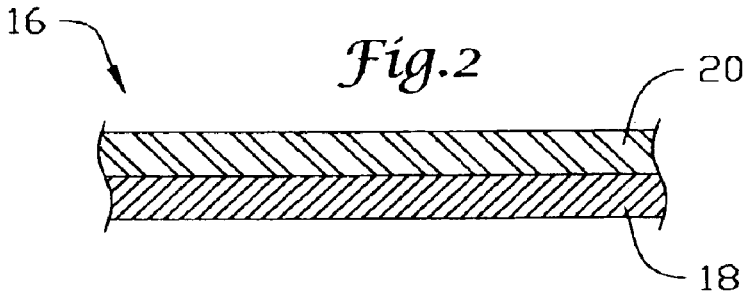
FIG. 2 is a diagrammatic cross-section view of a metal substrate that has been plated in accordance with an embodiment of the invention.

The methods described herein are applicable to a number of different medical devices. FIG. 2 diagrammatically illustrates a plated substrate 16 that includes a substrate 18 and a plating layer 20. The plating layer 20 can be a solderable material such as a tin-nickel mixture, or the plating layer 20 can be a radiopaque material such as tantalum or gold. Illustrative but non-limiting examples of medical devices that would benefit from being solderable include guidewires, filter support loops and vena cave filters. Virtually all intracorporeal medical devices such as intravascular devices can benefit from a radiopaque plating or coating.

In some embodiments, the plating layer 20 represents a solderable material and the substrate 18 generically represents a medical device or portion thereof that can be soldered to another medical device or portion thereof. In particular, the substrate 18 can be formed from or include a portion thereof that is formed from an oxidizable metal.

In some embodiments, the substrate 18 can be formed from a nickel-titanium alloy such as nitinol, stainless steel, gold, tantalum, titanium, beta titanium and metal alloys such as nickel-titanium alloy, nickel-chromium alloy, nickel-chromium-iron alloy, cobalt alloy, or other suitable material. In some embodiments, the substrate 18 can be a relatively stiff metal such as 304 v stainless steel or 316L stainless steel.

In some embodiments, the substrate 18 can be nitinol. The word nitinol was coined by a group of researchers at the United States Naval Ordinance Laboratory (NOL) who were the first to observe the shape memory behavior of this material. The word nitinol is an acronym including the chemical symbol for nickel (Ni), the chemical symbol for titanium (Ti), and an acronym identifying the Naval Ordinance Laboratory (NOL).

Once the substrate 18 has been plated to form the plated substrate 16, it can if desired be soldered to another material. The plated substrate 16 can be soldered to a solderable material that has not been plated, or if desired the plated substrate 16 can be soldered to another oxidizable material that has been plated in accordance with the invention.

Figure 3:
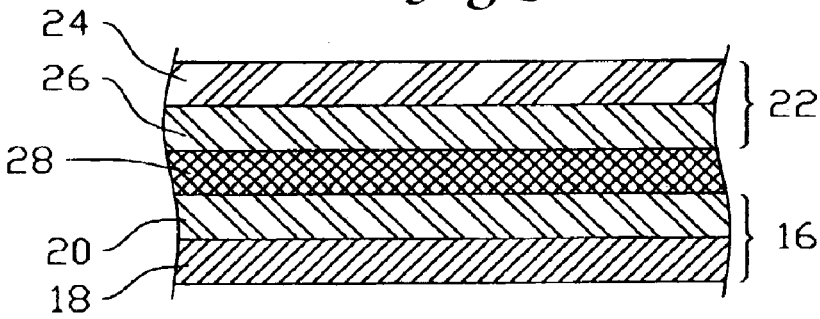
FIG. 3 is a diagrammatic cross-section view of two metal substrates that have each been plated and have subsequently been soldered together in accordance with an embodiment of the invention.

FIG. 3 illustrates the plated substrate 18 that has been soldered to a second plated substrate 22. The second plated substrate 22 includes a substrate 24 that can be formed of any suitable material, as outlined above, and a plating layer 26. The plated substrate 18 and the second plated substrate 22 can be secured together through a solder layer 28. Any suitable solder material can be used. In some embodiments, the solder includes a tin-silver mixture. In particular embodiments, the solder can include about 5 weight percent silver and about 95 weight percent tin.

As noted, FIG. 3 generically represents two medical devices or portions of medical devices that have been soldered together in accordance with the invention. Illustrative but non-limiting embodiments of medical devices that can be soldered include filter support loops, guidewires and vena cava filters. Each will be described, in turn.

Figure 4:
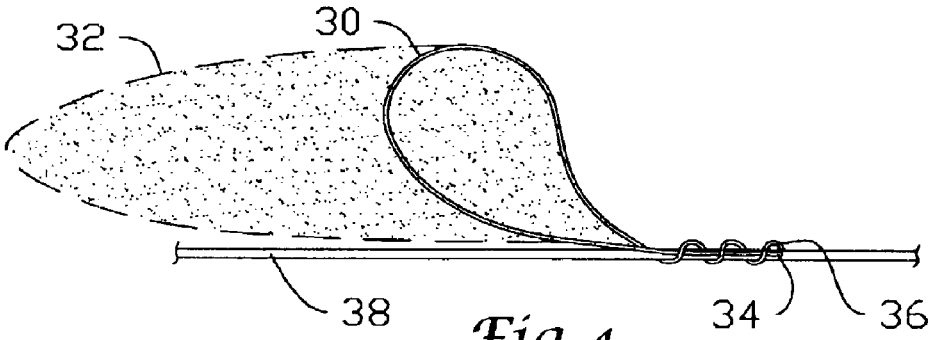
FIG. 4 is a perspective view of a filter support loop, positioned prior to soldering, in accordance with an embodiment of the invention.
Figure 5:
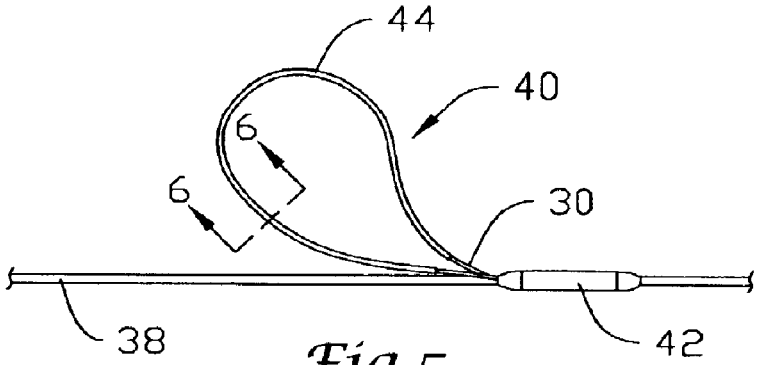
FIG. 5 is a perspective view of the filter support loop of FIG. 4, shown after soldering and with a radiopaque coating, in accordance with an embodiment of the invention.
Figure 6:
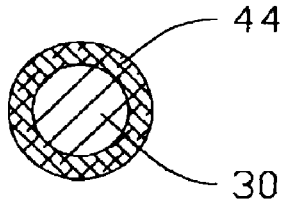
FIG. 6 is a cross-section view of the filter support loop of FIG. 5, taken along the 6—6 line.

FIGS. 4, 5 and 6 illustrate a distal protection filter support loop 30 that is configured to secure and support a distal protection filter membrane 32 (shown in phantom). The distal protection filter membrane 32 is of conventional design and manufacture. The support loop 30 can be formed from a variety of different materials. The support loop 30 can be formed from a wire that has been doubled over to have an end 34 and an end 36. In some embodiments, the support loop 30 is formed of a nitinol wire.

The wire ends 34 and 36 can be positioned in conjunction with a support wire 38. The support wire 38 can be formed from a variety of suitable materials. In some embodiments, the support wire 38 can be formed of stainless steel. The wire ends 34 and 36 can be positioned such that both are substantially parallel to the support wire 38.

In the illustrated embodiment, the wire end 34 is arranged in parallel to the support wire 38 while the wire end 36 is coiled around the support wire 38 and the wire end 34. In some embodiments, both end wires 34 and 36 can be positioned parallel to the support wire 38 and a separate wire or coil (not illustrate) could be coiled around the support wire 38 and the wire ends 34 and 36 to lend strength.

Once the support loop 30 has been positioned proximate the support wire 38, the wire ends 34 and 36 can be soldered to the support wire 38. As described above, any suitable solder such as a tin-nickel solder can be used. The soldered filter support structure 40 after soldering is illustrated for example in FIG. 5.

In FIG. 5, the support loop 30 has been soldered to the support wire 38, via solder mass 42. In some embodiments, as illustrated, at least a portion of the support loop 30 can include a coating or covering 44. See also FIG. 6. The coating or covering 44 can in some embodiments lend additional radiopacity to the support loop 30. In some embodiments, the coating or covering 44 can include gold, tantalum or other radiopaque materials. The coating or covering 44 can be a sleeve or coil that fits over the support loop 30. In some embodiments, the coating or covering 44 can be an electroplated coating that is provided in accordance with the inventive methods described herein.

Figure 7:
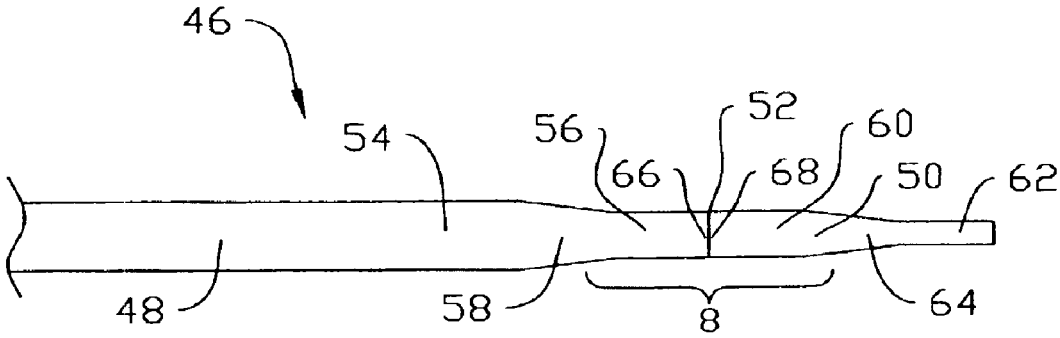
FIG. 7 is a partially sectioned view of a distal portion of a guidewire in accordance with an embodiment of the invention.

Guidewires represent another beneficial use for the plating methods of the invention. FIG. 7 for example shows a guidewire distal portion 46 that includes a proximal section 48 and a distal tip 50. The proximal section 48 and the distal tip 50 meet at a joint 52, which will be discussed in greater detail with respect to FIG. 8. As illustrated, the proximal section 48 includes two constant diameter portions 54 and 56 that are interrupted by a taper portion 58.

In other embodiments, the proximal section 48 can have a constant diameter, or alternatively can have more than one taper portion (not illustrated). The distal tip 5 as shown has two constant diameter portions 60 and 62 that are interrupted by a taper portion 64. This is merely an illustrative grind profile, as the distal tip 50 could include only a taper portion without any constant diameter portions, or it could include multiple taper portions.

Each of the proximal section 48 and the distal tip 50 can be formed from a variety of metallic materials. In some embodiments, one of the proximal section 48 and the distal tip 50 can be formed of nitinol while the other is formed of stainless steel. In some embodiments, the proximal section 48 is formed of nitinol having a first set of properties while the distal tip 50 is formed of nitinol having a second set of properties.

Figure 8:
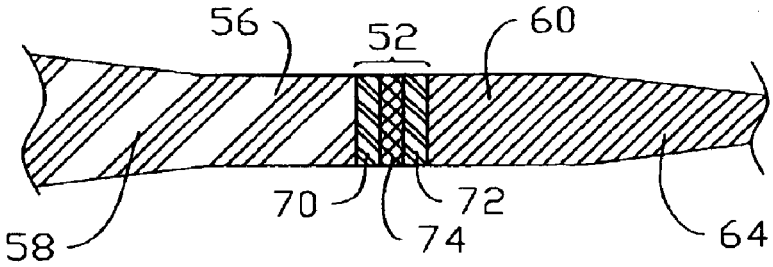
FIG. 8 is a partially sectioned view of a portion of FIG. 7.

FIG. 8 provides a better view of the joint 52. In accordance with particular embodiments of the invention, the distal end 66 of the proximal section 48 has been plated with a plating layer 70. Similarly, the proximal end 68 of the distal tip 50 has been plated with a plating layer 72.

Subsequently, the proximal section 48 has been soldered to the distal tip 50 by providing a solder layer 74 between the plating layer 70 and the plating layer 72.

Figure 9:
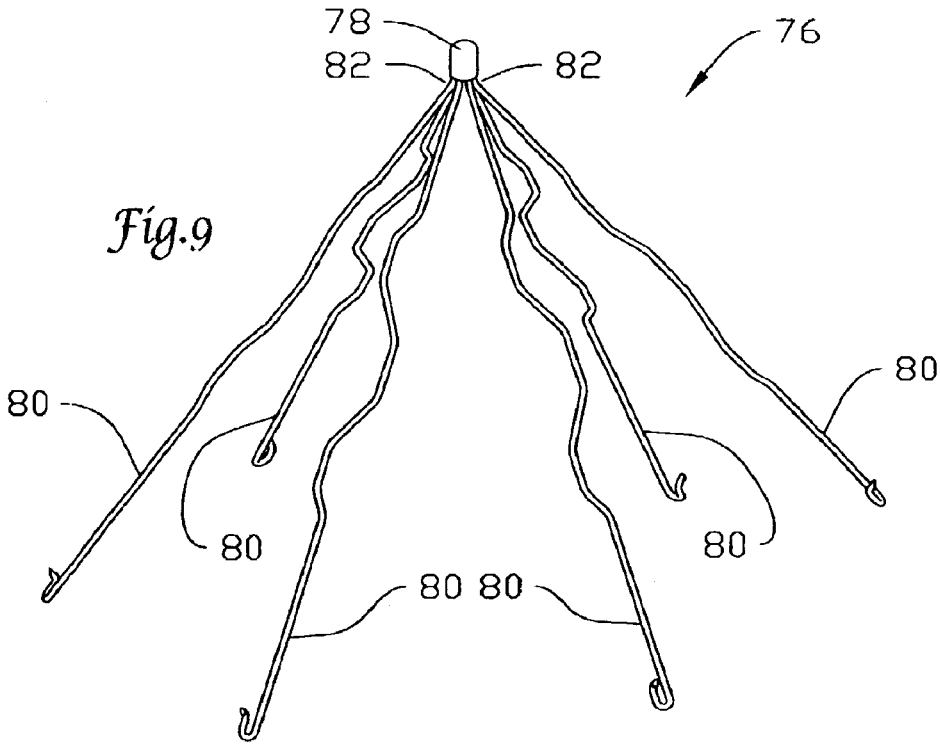
FIG. 9 is a perspective view of a vena cava filter in accordance with an embodiment of the invention.
Figure 10:
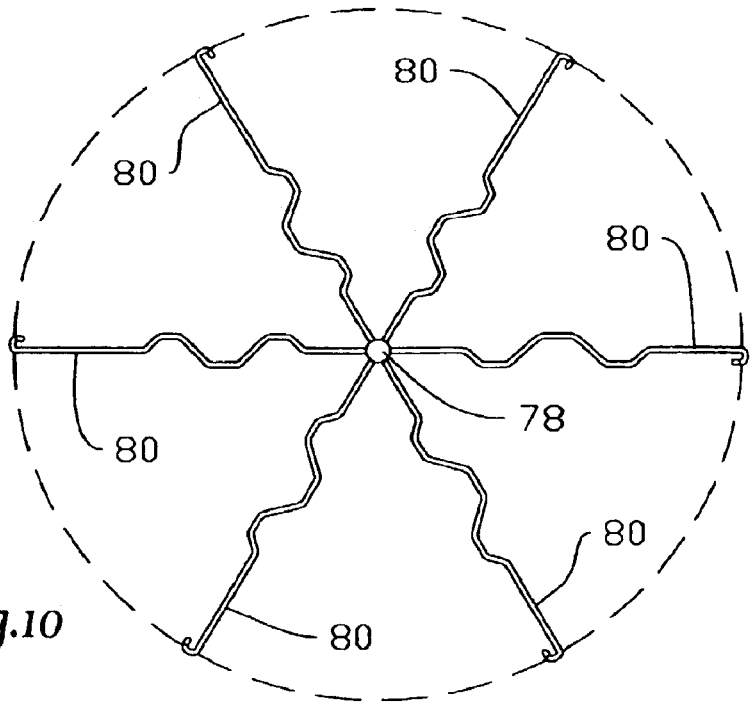
FIG. 10 is a top view of the vena cava filter of FIG. 9.

Intravascular filters such as vena cava filters represent another application of the invention. FIGS. 9 and 10 illustrate a filter 76 that has an apical head 78 and a number of struts 80 that are attached at a distal end 82 thereof to the apical head 78. As illustrated, each of the struts 80 are configured to radially expand to an outswept, conical-shaped position when deployed.

The apical head 78 can be formed of any suitable material, such as a metal or metal alloy. The struts 80 can may be formed from a metal or metal alloy such as titanium, platinum, tantalum, tungsten, stainless steel (e.g. type 304 or 316) or cobalt-chrome. In some embodiments, the struts 80 are formed of titanium, which is highly oxidizable. In some embodiments, the struts 80 can be formed from nitinol.

In some embodiments, the distal ends 82 of each strut 80 can undergo the activation, rinse and plating steps described herein prior to being soldered to the apical head 78. Depending on the identity of the material used to form the apical head 78, it can be beneficial to also activate, rinse and plate the apical head 78 prior to attaching the struts 80.

We claim:

1. A method of plating a medical device, the medical device comprising an oxidizable substrate, the method comprising:

cleaning the substrate with a cleaning and etching solution;

activating the substrate with a concentrated aqueous solution of ammonium bifluoride;

wherein the concentrated ammonium bifluoride solution comprises about 10 to 40 weight percent ammonium bifluoride;

rinsing the substrate with a dilute aqueous solution of ammonium bifluoride; and plating the substrate with a plating material.

2. The method of claim 1, wherein the medical device comprises one of a guidewire or a filter wire.

3. The method of claim 1, wherein the substrate comprises stainless steel.

4. The method of claim 1, wherein the substrate comprises titanium or a nickel/titanium alloy.

5. The method of claim 1, wherein activating the substrate results in any oxidized metal present on a surface of the substrate being reduced to the metal itself.

6. The method of claim 1, wherein rinsing the substrate with the dilute ammonium bifluoride solution rinses excess ammonium bifluoride from the substrate but leaves sufficient ammonium bifluoride to yield temporary protection against oxidation.

7. The method of claim 1, wherein the dilute ammonium bifluoride solution comprises about 1 to 10 weight percent ammonium bifluoride.

8. The method of claim 1, wherein plating the substrate comprises electroplating.

9. The method of claim 1, wherein plating the substrate comprises reverse current electroplating.

10. The method of claim 1, wherein the plating material comprises from 60 to 70 weight percent tin and from 30 to 40 weight percent nickel.

11. The method of claim 1, wherein the plating material comprises gold.

12. The method of claim 1, wherein the cleaning and etching solution comprises sulfamic acid and hydrogen peroxide.

13. A method of forming a medical device comprising a first metal part and a second metal part, the first metal part comprising an oxidizable metal, the method comprising:

cleaning the first metal part with a cleaning and etching solution;

activating the first metal part with a concentrated aqueous solution of ammonium bifluoride;

wherein the concentrated ammonium bifluoride solution comprises about 10 to 40 weight percent ammonium bifluoride;

rinsing the first metal part with a dilute aqueous solution of ammonium bifluoride;

electroplating the first metal part; and soldering said plated first metal part to said second metal part.

14. The method of claim 13, wherein the first metal part comprises one of stainless steel, nitinol or titanium.

15. The method of claim 13, wherein the second metal part comprises one of stainless steel, nitinol or titanium.

16. The method of claim 13, wherein the concentrated ammonium bifluoride solution comprises about 25 weight percent ammonium fluoride.

17. The method of claim 16, wherein the soldering comprises using flux and a silver/tin solder comprising about 5 weight percent silver and about 95 weight percent tin.

18. The method of claim 16, wherein the first metal part comprises a guidewire shaft and the second metal part comprises a guidewire distal tip.

19. The method of claim 16, wherein the first metal part comprises a vena cava filter strut and the second metal part comprises a vena cava filter hub.

20. The method of claim 13, wherein the dilute ammonium bifluoride solution comprises about 5 weight percent ammonium fluoride.

21. The method of claim 13, wherein the cleaning solution comprises a mixture of sulfamic acid and hydrogen peroxide.

22. The method of claim 13, wherein the step of electroplating the first metal part includes electroplating the first metal part with a plating material, and wherein the plating material comprises about 65 weight percent tin and about 35 weight percent nickel.

23. The method of claim 13, further comprising, prior to soldering the first metal part to the second metal part, steps of:

cleaning the second metal part with the cleaning and etching solution;

activating the second metal part with the concentrated aqueous solution of ammonium bifluoride;

rinsing the second metal part with the dilute aqueous solution of ammonium bifluoride; and electroplating the second metal part.

24. The method of claim 23, wherein the step of eletroplating the second metal part includes electroplating the second metal part with a plating material, and wherein the plating material comprises about 65 weight percent tin and about 35 weight percent nickel.

25. The method of claim 23, wherein the step of electroplating the second metal part comprises reverse current electroplating.

26. The method of claim 13, wherein the step of electroplating the first metal part comprises reverse current electroplating.

27. A method of forming a filter wire loop, the filter wire loop comprising a nitinol filter wire secured to a stainless steel wire, the filter wire having a first end and a second end, the method comprising steps of:

cleaning each of the first and second ends with a cleaning and etching solution;

activating each of the first and second ends with a first aqueous solution comprising about 10 to 40 weight percent ammonium bifluoride;

rinsing each of the first and second ends with a second aqueous solution comprising about 1 to 10 weight percent ammonium bifluoride;

electroplating each of the first and second ends with a plating material comprising nickel; and positioning the plated first and second ends in alignment with the stainless steel wire and soldering the plated first and second ends of the filter wire to the stainless steel wire.

28. The method of claim 27, wherein the step of positioning the plated first and second ends comprises coiling at least one of the first and second ends around the stainless steel wire.

29. The method of claim 27, wherein the first ammonium bifluoride solution comprises about 25 weight percent ammonium fluoride.

30. The method of claim 27, wherein the second ammonium bifluoride solution comprises about 5 weight percent ammonium fluoride.

31. The method of claim 27, wherein the cleaning solution comprises a mixture of sulfamic acid and hydrogen peroxide.

32. The method of claim 27, wherein the plating material comprises about 65 weight percent tin and about 35 weight percent nickel.

33. The method of claim 27, wherein the step of electroplating comprises reverse current electroplating.

34. The method of claim 27, wherein soldering comprises using flux and a silver/tin solder comprising about 5 weight percent silver and about 95 weight percent tin.

35. A method of making a medical device radiopaque, the medical device comprising an oxidizable substrate, the method comprising steps of:

cleaning the substrate with a cleaning and etching solution;

activating the substrate with a first aqueous solution comprising about 10 to 40 weight percent ammonium bifluoride;

rinsing the substrate with a second aqueous solution comprising about 1 to 10 weight percent ammonium bifluoride; and electroplating the substrate with a radiopaque material.

36. The method of claim 35, wherein the first ammonium bifluoride solution comprises about 25 weight percent ammonium fluoride.

37. The method of claim 35, wherein the second ammonium bifluoride solution comprises about 5 weight percent ammonium fluoride.

38. The method of claim 35, wherein the cleaning solution comprises a mixture of sulfamic acid and hydrogen peroxide.

39. The method of claim 35, wherein the step of electroplating comprises reverse current electroplating.

40. The method of claim 35, wherein the radiopaque material comprises gold.

41. The method of claim 35, wherein the medical device comprises one of a nitinol stent, a nitinol guidewire, a stainless steel guidewire, or a nitinol filter wire loop.

* * * * *